US009820507B2

(12) United States Patent
Williams

(10) Patent No.: US 9,820,507 B2
(45) Date of Patent: Nov. 21, 2017

(54) METHOD OF MAKING ORAL POUCH PRODUCT

(71) Applicant: Altria Client Services Inc., Richmond, VA (US)

(72) Inventor: Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 105 days.

(21) Appl. No.: 14/799,933

(22) Filed: Jul. 15, 2015

(65) Prior Publication Data

US 2015/0342253 A1 Dec. 3, 2015

Related U.S. Application Data

(62) Division of application No. 13/085,156, filed on Apr. 12, 2011, now Pat. No. 9,126,704.

(60) Provisional application No. 61/323,181, filed on Apr. 12, 2010.

(51) Int. Cl.

| | |
|---|---|
| ***A24F 23/00*** | (2006.01) |
| ***A24B 13/00*** | (2006.01) |
| ***B65B 9/08*** | (2012.01) |
| ***B65B 9/20*** | (2012.01) |
| ***B65B 9/22*** | (2006.01) |
| ***B65B 29/00*** | (2006.01) |
| ***B65D 30/08*** | (2006.01) |

(52) U.S. Cl.

CPC ..... *A24F 23/00* (2013.01); *A24B 13/00* (2013.01); *B65B 9/08* (2013.01); *B65B 9/20* (2013.01); *B65B 9/2028* (2013.01); *B65B 9/22* (2013.01); *B65B 29/00* (2013.01); *B65D 31/02* (2013.01); *B65B 2220/08* (2013.01)

(58) Field of Classification Search

USPC ..... 131/112, 352, 358, 366–369, 359; 206/242, 260, 245, 271, 274; 53/285, 53/370.2, 452, 456, 476, 574

See application file for complete search history.

(56) References Cited

U.S. PATENT DOCUMENTS

| | | | |
|---|---|---|---|
| 307,537 | A | 11/1884 | Foulks |
| 1,234,279 | A | 7/1917 | Buchanan |
| 1,992,152 | A | 2/1935 | Yates |

(Continued)

FOREIGN PATENT DOCUMENTS

| | | | |
|---|---|---|---|
| DE | 79 09 729 | U1 | 8/1979 |
| DE | 39 15 635 | A1 | 11/1990 |
| DE | 296 05 787 | U1 | 6/1996 |
| EA | 200702372 | A1 | 6/2008 |
| EP | 0 145 499 | A2 | 6/1985 |
| EP | 0 352 107 | A2 | 1/1990 |
| EP | 0 483 500 | A1 | 5/1992 |
| EP | 0 422 898 | A1 | 4/1994 |
| EP | 0 599 425 | A1 | 6/1994 |

(Continued)

OTHER PUBLICATIONS

"Buy Swedish Snus Online-BuySnus.com", 2010, 4 pages, [online], retrieved from the Internet, [retrieved on Mar. 11, 2017], <URL: https://www.buysnus.com/>.*

(Continued)

*Primary Examiner* — Dennis Cordray

(74) *Attorney, Agent, or Firm* — Buchanan Ingersoll & Rooney PC

(57) ABSTRACT

An oral tobacco pouch product includes a pouch wrapper formed of a web having a longitudinal integrated fin and lap seal. The pouch wrapper contains a filling material including tobacco material and optional additives. The longitudinal integrated fin and lap seal is formed on a forming collar.

16 Claims, 5 Drawing Sheets

(56) References Cited

U.S. PATENT DOCUMENTS

| | | | |
|---|---|---|---|
| 2,313,696 | A | 3/1941 | Yeates |
| 2,306,400 | A | 12/1942 | Menzel |
| 2,330,361 | A | 9/1943 | Howard |
| 2,385,897 | A | 10/1945 | Waters |
| 2,528,778 | A | 11/1950 | Piazze |
| 2,569,140 | A | 9/1951 | Avery |
| 3,084,984 | A | 4/1963 | Adler |
| 3,188,265 | A | 6/1965 | Charbonneau et al. |
| 3,415,286 | A | 12/1968 | Arnold et al. |
| 3,607,299 | A | 9/1971 | Bolt |
| 3,757,798 | A | 9/1973 | Lambert |
| 3,846,569 | A | 11/1974 | Kaplan |
| 4,532,754 | A | 8/1985 | Hokanson |
| 4,607,479 | A | 8/1986 | Linden |
| 4,703,765 | A | 11/1987 | Paules et al. |
| 4,880,697 | A | 11/1989 | Caldwell et al. |
| 4,907,605 | A | 3/1990 | Ray et al. |
| 5,127,208 | A | 7/1992 | Custer et al. |
| 5,133,980 | A | 7/1992 | Ream et al. |
| 5,167,244 | A | 12/1992 | Kjerstad |
| 5,174,088 | A | 12/1992 | Focke et al. |
| 5,442,897 | A | 8/1995 | Hinzmann et al. |
| 5,601,716 | A | 2/1997 | Heinrich et al. |
| 5,806,408 | A | 9/1998 | DeBacker et al. |
| 5,927,052 | A | 7/1999 | Nippes et al. |
| 6,021,624 | A | 2/2000 | Richison et al. |
| 6,135,120 | A | 10/2000 | Lofman et al. |
| 6,143,316 | A | 11/2000 | Hayden et al. |
| 6,146,655 | A | 11/2000 | Ruben |
| 6,162,516 | A | 12/2000 | Derr |
| 6,553,744 | B1 * | 4/2003 | Terminella ..... B65B 9/20 53/551 |
| D489,606 | S | 5/2004 | Lofman |
| 6,871,473 | B1 | 3/2005 | Dutt et al. |
| 7,090,858 | B2 | 8/2006 | Jayaraman |
| D568,576 | S | 5/2008 | Neidle et al. |
| D585,626 | S | 2/2009 | Chappell, Sr. et al. |
| 7,584,843 | B2 | 9/2009 | Kutsch et al. |
| 7,861,728 | B2 | 1/2011 | Holton, Jr. et al. |
| 7,980,251 | B2 | 7/2011 | Winterson et al. |
| 2002/0012689 | A1 | 1/2002 | Stillman |
| 2002/0073656 | A1 | 6/2002 | Geldhauser |
| 2002/0170567 | A1 | 11/2002 | Rizzotto et al. |
| 2003/0093971 | A1 | 5/2003 | Terminella et al. |
| 2003/0224090 | A1 | 12/2003 | Pearce et al. |
| 2004/0018293 | A1 | 1/2004 | Popplewell et al. |
| 2004/0118421 | A1 | 6/2004 | Hodin et al. |
| 2004/0247649 | A1 | 12/2004 | Pearce et al. |
| 2004/0247744 | A1 | 12/2004 | Pearce et al. |
| 2004/0247746 | A1 | 12/2004 | Pearce et al. |
| 2005/0003048 | A1 | 1/2005 | Pearce et al. |
| 2005/0034738 | A1 | 2/2005 | Whalen |
| 2005/0100640 | A1 | 5/2005 | Pearce |
| 2005/0244521 | A1 | 11/2005 | Strickland et al. |
| 2006/0073190 | A1 | 4/2006 | Carroll et al. |
| 2006/0118589 | A1 | 6/2006 | Arnarp et al. |
| 2006/0191548 | A1 | 8/2006 | Strickland et al. |
| 2007/0012328 | A1 | 1/2007 | Winterson et al. |
| 2007/0062549 | A1 | 3/2007 | Holton, Jr. et al. |
| 2007/0095356 | A1 | 5/2007 | Winterson et al. |
| 2007/0122526 | A1 | 5/2007 | Sweeney et al. |
| 2007/0186941 | A1 | 8/2007 | Holton, Jr. et al. |
| 2007/0186942 | A1 | 8/2007 | Strickland et al. |
| 2007/0186943 | A1 | 8/2007 | Strickland et al. |
| 2007/0186944 | A1 | 8/2007 | Strickland et al. |
| 2007/0190157 | A1 | 8/2007 | Sanghvi et al. |
| 2007/0207239 | A1 | 9/2007 | Neidle et al. |
| 2007/0261707 | A1 | 11/2007 | Winterson et al. |
| 2007/0298061 | A1 | 12/2007 | Boghani et al. |
| 2008/0029110 | A1 | 2/2008 | Dube et al. |
| 2008/0029116 | A1 | 2/2008 | Robinson et al. |
| 2008/0029117 | A1 | 2/2008 | Mua et al. |
| 2008/0081071 | A1 | 4/2008 | Sanghvi et al. |
| 2008/0171110 | A1 | 7/2008 | Stuart |
| 2008/0173317 | A1 | 7/2008 | Robinson et al. |
| 2008/0196730 | A1 | 8/2008 | Engstrom et al. |
| 2008/0202536 | A1 | 8/2008 | Torrence et al. |
| 2008/0271418 | A1 | 11/2008 | Doll |
| 2008/0302682 | A1 | 12/2008 | Ensgtrom et al. |
| 2008/0308115 | A1 | 12/2008 | Zimmerman et al. |
| 2008/0317911 | A1 | 12/2008 | Schleef et al. |
| 2009/0000968 | A1 | 1/2009 | Smith et al. |
| 2009/0004329 | A1 | 1/2009 | Gedevanishvili et al. |
| 2009/0022856 | A1 | 1/2009 | Cheng et al. |
| 2009/0022917 | A1 | 1/2009 | Gedevanishvili et al. |
| 2009/0025740 | A1 | 1/2009 | Chappell, Sr. et al. |
| 2009/0025741 | A1 | 1/2009 | Crawford et al. |
| 2009/0035414 | A1 | 2/2009 | Cheng et al. |
| 2009/0038631 | A1 | 2/2009 | Mishra |
| 2009/0113852 | A1 | 5/2009 | Cecil et al. |
| 2009/0126746 | A1 | 5/2009 | Strickland et al. |
| 2010/0218779 | A1 | 9/2010 | Zhuang et al. |
| 2010/0300464 | A1 | 12/2010 | Gee et al. |
| 2010/0300465 | A1 | 12/2010 | Zimmermann et al. |
| 2011/0083680 | A1 | 4/2011 | Mishra et al. |
| 2011/0083685 | A1 | 4/2011 | Adams et al. |
| 2011/0180087 | A1 | 7/2011 | Gee et al. |
| 2011/0236442 | A1 | 9/2011 | Miser et al. |

FOREIGN PATENT DOCUMENTS

| | | | |
|---|---|---|---|
| EP | 1 946 652 | A1 | 7/2008 |
| GB | 1 350 470 | | 4/1974 |
| GB | 2 074 838 | A | 11/1981 |
| JP | 03-240665 | A | 10/1991 |
| JP | 7-101463 | A | 4/1995 |
| JP | H10-17017 | A | 1/1998 |
| JP | 2006-111311 | A | 4/2006 |
| JP | 2008-230700 | A | 10/2008 |
| JP | 2008-538911 | A | 11/2008 |
| SU | 406778 | A1 | 11/1973 |
| WO | 94/25356 | A1 | 11/1994 |
| WO | 97/45336 | A1 | 12/1997 |
| WO | 99/40799 | A1 | 8/1999 |
| WO | 01/70591 | A1 | 9/2001 |
| WO | 02/080707 | A1 | 10/2002 |
| WO | 03/028492 | A1 | 4/2003 |
| WO | 03/030881 | A1 | 4/2003 |
| WO | 03/053175 | A2 | 7/2003 |
| WO | 03/086119 | A1 | 10/2003 |
| WO | 2004/009445 | A2 | 1/2004 |
| WO | 2004/052335 | A1 | 6/2004 |
| WO | 2004/056219 | A1 | 7/2004 |
| WO | 2004/058217 | A2 | 7/2004 |
| WO | 2004/066986 | A1 | 8/2004 |
| WO | 2004/095959 | A1 | 11/2004 |
| WO | 2005/027815 | A1 | 3/2005 |
| WO | 2005/046363 | A2 | 5/2005 |
| WO | 2005/077232 | A2 | 8/2005 |
| WO | 2005/115180 | A1 | 12/2005 |
| WO | 2006/004480 | A1 | 1/2006 |
| WO | 2006/039487 | A2 | 4/2006 |
| WO | 2006/065192 | A1 | 6/2006 |
| WO | 2006/005173 | A2 | 10/2006 |
| WO | 2006/120570 | A2 | 11/2006 |
| WO | 2006/127772 | A2 | 11/2006 |
| WO | 2007037962 | A1 | 4/2007 |
| WO | 2007/057789 | A2 | 5/2007 |
| WO | 2007/057791 | A2 | 5/2007 |
| WO | 2007/082599 | A1 | 7/2007 |
| WO | 2007/104573 | A2 | 9/2007 |
| WO | 2007/126361 | A1 | 11/2007 |
| WO | 2008/016520 | A2 | 2/2008 |
| WO | 2008/042331 | A2 | 4/2008 |
| WO | 2008/104891 | A2 | 9/2008 |

OTHER PUBLICATIONS

Official Action in Russian language, for Russian Patent Application No. 2012147909/13. English translation of the Official Action. (14 pages).

Official Action dated Dec. 2, 2014, for Japanese Patent Application No. 2013-504888.

(56) References Cited

OTHER PUBLICATIONS

Satel, Sally M.D., "A Smokeless Alternative to Quitting," Apr. 6, 2004, The New York Times, Accessed Oct. 25, 2010; http://query.nytimes.com/gst/fullpage.html?res=9402EFD91E39F935A3-5757C0A9629C8B63.
International Search Report and Written Opinion dated Jun. 28, 2011, for International Application No. PCT/US2011/000665.
European Search Report dated Oct. 10, 2013, for European Application No. 11769207.9-1708.
European Patent Office Communication corresponding to European Patent Application No. 11769207.9; dated Jun. 1, 2016; 6 pages.
Office Action (Notification of Reasons for Refusal) dated Oct. 27, 2015, by the Japanese Patent Office in Japanese Patent Application No. 2013-504888 and an English Translation of the Office Action. (11 pages).

* cited by examiner

METHOD OF MAKING ORAL POUCH PRODUCT

SUMMARY

This application is a divisional of U.S. application Ser. No. 13/085,156, filed on Apr. 12, 2011, which claims priority to U.S. Provisional Application No. 61/323,181, filed on Apr. 12, 2010, the entire content of which is incorporated herein by reference.

It is desired to produce a pouched product having a base web folded into a "pillow shape" and having preferably mutual parallel transverse seams at its opposite end portions and a longitudinal seam in orthogonal relation to the transverse seams. The challenge is to construct the pouch such that the longitudinal seam has strength sufficient to maintain integrity of the pouch during handling or the like. In applications such as tobacco containing pouched products that are intended for oral enjoyment of tobacco, it is also desired that the longitudinal seam does not present raised or curled edges along the longitudinal seam which might otherwise detract from enjoyment of the tobacco product.

An improved pouch product comprises a web folded into a pouched form, a filling material contained by said pouched form, and a longitudinal seam disposed along the pouched form. Preferably, the longitudinal seam comprises a fin seam established between opposing edge portions of the web. Also preferably, the fin seam is folded into a superposed relation to an adjacent portion of the folded form. The longitudinal seam further comprises a seal established along said superposed fin seam and said adjacent portion of said folded form.

In the preferred embodiment, the filling material comprises tobacco material, preferably a moist smokeless tobacco. In addition to or in lieu of tobacco material, the filling material may include non-tobacco botanical material selected from the group consisting of vegetable fibers, tea, herbs, spices, coffee, fruits and combinations thereof. Preferably, the filling material has a moisture content in the range of about 5% to about 50%, more preferably, about 12% to about 25%.

In one embodiment, the web can also include at least one coating, which can be a polymeric coating. The coating can be on an inner and/or outer surface of the web. The coating can include at least one additive selected from the group consisting of flavorants, sweeteners, and combinations thereof.

A method of making an oral tobacco pouch product comprises folding a web into a tubular form with opposite longitudinal edge portions in an opposing relation along the tubular form, forming a fin seam along the opposing edges of the tubular form, folding the fin seam into a superposed relation to an outer surface of the tubular form, sealing the fin seam to the outer surface of the tubular form to form a combination fin and lap seal, forming a lower transverse seam across the tubular formation, placing a portion of a filling material comprising tobacco material into the tubular formation above the transverse seam, and forming an upper transverse seam across the tubular formation to enclose the filling material.

In yet another embodiment, a method of forming a longitudinal seam along a body of a pouched consumable product comprises the steps of: forming a fin along a tubular formation, sealing the formed fin, folding the sealed, formed fin into a superposed relation with an outer surface of the tubular formation, and sealing the folded, sealed, formed fin to the outer surface of the tubular formation to form a combination fin and lap seal.

A forming collar useful in carrying out the foregoing methods comprises a fin forming station for forming a fin seam and/or seal along a web, and a lap seal forming station for adhering the fin seal to an outer surface of the web.

DETAILED DESCRIPTION

Described herein is an oral tobacco pouch product having a longitudinal integrated fin and lap seal. Also described herein is a method and apparatus for forming the integrated fin and lap seal. Preferably, the pouch is formed on a high speed, vertical fill and seal machine, such as the pouching apparatus manufactured and sold by, for example, Merz Verpackungsmaschinen GmbH, Lich, Germany. The teachings herein may also be applied to other pouching apparatus manufactured and sold by, for example, Ropak Manufacturing Company, Inc. of Decatur, Ala. Also preferably, the oral tobacco pouch product having a longitudinal integrated fin and lap seal combines the comfort of a lap seal when placed in a user's mouth with the strength of a fin seal that is not prone to breakage during use.

As used herein, the term "oral tobacco pouch product" generally denotes a pouch product which fits in a user's mouth and delivers a desirable taste, aroma, or integrated of two or more of these for tobacco enjoyment when placed through contact with the consumer's taste buds, olfactory receptors, or both, preferably via the consumer's saliva.

Figure 1:
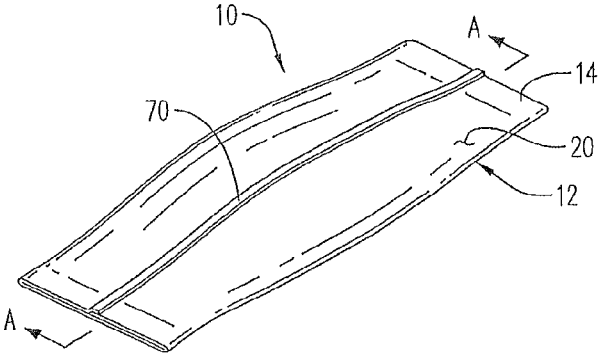
FIG. 1 is a perspective view of an oral tobacco pouch product.

As described herein and illustrated in FIG. 1, an oral tobacco pouch product 10 comprises a pouch wrapper formed by a web 12 and a filling material (shown in FIGS. 2 and 3) contained within the web 12. The oral tobacco pouch product 10 is designed to be placed in the mouth, preferably between the cheek and gum, for oral enjoyment.

Figure 2:
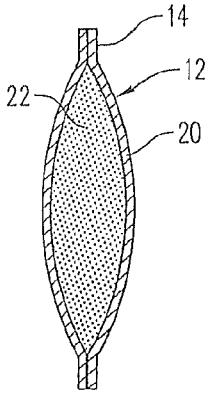
FIG. 2 is a cross-sectional view of a first embodiment of an oral tobacco pouch product in the direction of double arrow A-A in FIG. 1.

As shown in FIGS. 1 and 2, the web 12 comprises an outer web 20 that is formed of a permeable or semi-permeable material, such that saliva can pass through the outer web 20 to the interior of the pouch product 10, and the flavors and juices from the filling material contained within the interior of the pouch product 10 can be drawn out of the pouch during use.

In a preferred embodiment, outer web 20 comprises paper suitable for oral pouch products commonly referred to as "snus" or snuff. For example, the web can be formed of a cellulose fiber material, such as tea bag material or other materials typically used to form snus pouches. Desirably, the outer web 20 of the porous pouch wrapper 12 is made from a material suitable for contact with food, such as materials used in packaging or handling foods. Preferably, the material used to form the web 20 has a neutral or pleasant taste or aroma. Preferably, the material used to form the web 20 is selected to have desired properties of stain resistance, water permeability and/or porosity, and/or water insolubility.

Additionally, the materials used to form the outer web 20 can be provided with predetermined levels for basis weight and/or wet strength in order to reduce occurrence of breakage of the pouch wrapper 12 during manufacturing operations, storage and use. One exemplary material is a tea bag material with a basis weight of about 16.5 g/m2 with a wet tensile CD strength of 68 N/m.

It is also noted that the thickness of the outer web 20 can be varied to achieve desired levels of solubility through the pouch wrapper 12. For example. the paper can be about 0.1 mm to about 0.125 mm thick or about 0.07 mm to about 0.08 mm thick.

In a preferred embodiment, the web 12 maintains sufficient structural integrity during the time period that the web 12 is used so that the filling material 22 is retained therein. A longitudinal integrated fin and lap seal 70 can be formed along edges of the web 12 to contain the filling material. The integrated fin and lap seal 70 provides the comfort of a lap seal along with the strength of a fin seal so as to prevent breakage during placement and use. In the preferred embodiment, the longitudinal integrated fin and lap seal 70 is about 2 mm to about 15 mm wide.

In an embodiment, flavorants may be added to the web 12 to provide additional flavor to the user. For example, peppermint oil can be applied to the web 12 to deliver flavor during use.

Figure 3:
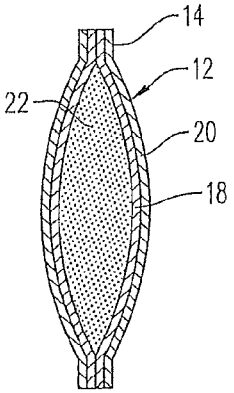
FIG. 3 is a cross-sectional view of a second embodiment of an oral tobacco pouch product in the direction of double arrow A-A in FIG. 1.

Preferably, as shown in FIGS. 2 and 3, the filling material 22 comprises tobacco material and optional additives. Preferably, the filling material has a moisture content of about 5% to about 50%. More preferably, the filling material has a moisture content of about 12% to about 25%. Even more preferably, the filling material has a moisture content of about 15% to about 20%.

Exemplary tobacco materials can be made of cut or ground tobacco and can include flavorants, additives and/or humectants. Examples of suitable types of tobacco materials that may be used include, but are not limited to, flue-cured tobacco, Burley tobacco, Maryland tobacco, Oriental tobacco, rare tobacco, specialty tobacco, reconstituted tobacco, blends thereof and the like. In a preferred embodiment, the tobacco material is pasteurized. In the alternative, the tobacco may be fermented.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, tobacco beads, blends thereof, and the like. Genetically modified tobacco and other treated tobaccos may also be used in the filling material 22. Also preferably, the tobacco material is smaller than about 20 mesh for ease of pouching.

In a preferred embodiment, in addition to or in lieu of tobacco material, the filling material 22 can also include a supplemental amount of botanical material other than tobacco, such as tea, coffee, herbs, spices, and/or vegetable fibers.

In another embodiment, additives can also be added to the filling material 22 and/or web 12 of the oral tobacco pouch product 10. Suitable additives include, without limitation, humectants, flavorants, sweeteners, and/or combinations thereof.

Humectants can also be added to the pouched tobacco product.

Suitable flavorants include any flavorants commonly used in foods, confections, smokeless tobacco products, tobacco articles, and/or other oral products.

In a preferred embodiment, the oral tobacco pouch product 10 is sized and configured to fit comfortably in a user's mouth, preferably between the cheek and gum. A user can suck, chew, or otherwise orally manipulate the oral tobacco pouch product 10 to release the flavors contained therein.

Preferably, the oral tobacco pouch product 10 weighs about 0.1 g to about 5.0 g. These ranges for weight can be further restricted to (a) about 0.1 g to about 1.0 g, (b) about 1.0 g to about 2.0 g, (c) about 2.0 g to about 3.0 g, (d) about 3.0 g to about 4.0 g or (e) about 4.0 g to about 5.0 g. Also preferably, the oral tobacco pouch product 10 is 10 mm to about 20 mm in width, about 20 mm to about 40 mm in length, and about 5 mm to about 20 mm thick.

The oral tobacco pouch product 10 may have a generally square, generally rectangular, generally quadrilateral, or generally oblong shape. In some embodiments, the pouch-shape can be similar to a ravioli or pillow shape. Other shapes may be utilized so long as the shapes fit comfortably and discreetly in a user's mouth.

Preferably, sharp corners are avoided as sharp corners may lead to oral discomfort. In a preferred embodiment, the web 12 is sealed around one or more edges to contain the filling material 22 within the web 12.

The oral tobacco pouch product 10 can preferably deliver a plurality of flavorants to the user for a period of about 1 minute to about 3 hours.

Figure 4:
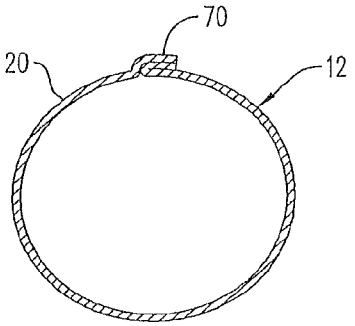
FIG. 4 is a cross-sectional view showing the longitudinal seam of the oral tobacco pouch product.

As shown in FIG. 1 and FIG. 4, in the preferred embodiment, the oral tobacco pouch product 10 comprises a longitudinal seal 70 in the form of a integrated fin and lap seal. The integrated fin and lap seal 70 is formed by first forming a fin seam such that an inner surface of the outer web 20 of the pouch wrapper 12 and another section of the inner surface of the outer web 20 are brought together in a superposed relation to form the fin seam. In one embodiment, the fin seam can then be sealed. In the preferred embodiment, the fin seam or seal is then lap sealed to an outer surface of the outer web 20 to form the integrated fin and lap seal. By sealing the fin seal to the web 12, the oral tobacco pouch product 10 is more comfortable for insertion in a user's mouth because there are no loose, unsealed edges to stick out and snag the user's mouth during enjoyment of the oral tobacco pouch product 10. In addition, the integrated fin and lap seal is stronger so as to prevent breakage during placement and use of the oral tobacco pouch product. In the preferred embodiment, the oral tobacco pouch product 10 also includes at least one transverse seam 14.

As shown in FIG. 3, the web 12 may comprise an inner web or film (or "liner") 18 and an outer web 20. The inner web 18 can slow the release of flavors through the web of the pouch. In addition, the inner web can aid in preventing discoloration of the outer web. The inner web may be attached to the outer web. Alternatively, the inner web and the outer web are not attached. In the preferred embodiment, the inner web 18 is made of the same material as the outer web 20. In other embodiments, the inner web 18 can be made of a different material than the outer web 20, preferably such as a dissolvable flavor film. The dissolvable film may abates stating of the pouch web by the tobacco and/or releases a flavor upon dissolution during use. Examples of such dissolvable strips and/or films are described in commonly assigned U.S. Patent Application Publication No. 2007-0012329-A1, filed on Apr. 28, 2006 (U.S. Utility patent application Ser. No. 11/412,842), the entire content of which is incorporated herein by reference.

In another preferred embodiment, the inner web 18 reduces the tendency of the filling material 22 to discolor (stain) the outer web 20. The inner web 18 reduces staining of the outer web 20 by reducing the opportunity for moisture from the filling material 22 or its additives to reach the outer web 20 prior to use. The inner web 18 also allows the moisture content and other constituents of the filling material 22 to be maintained in its original (fresh) condition until use. In an embodiment, the integrated fin and lap seal can include both the inner web 18 and the outer web 20. In other embodiments, the inner web 18 may not be included in the integrated fin and lap seal.

Figure 5A:
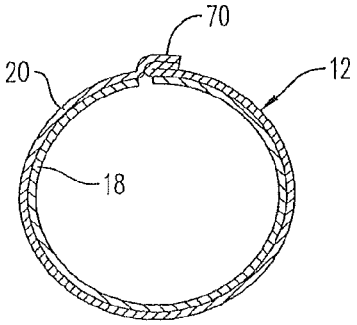
FIG. 5A is a cross-sectional view showing the longitudinal seam of the oral tobacco pouch product utilizing a flavor film that is centered along the ribbon of base web and FIG. 5B is an illustration of the film centered along the ribbon of base web.
Figure 5B:
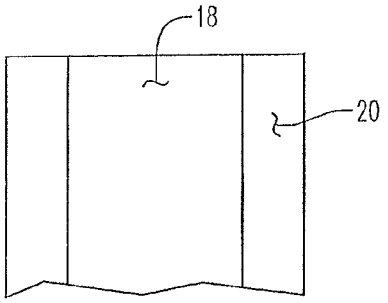

As shown in FIG. 5A, in one embodiment, the inner web 18 can be a film that does not overlap at the longitudinal fin and lap seal. When forming such a seal, the inner web 18 is centered along the outer web 20 as shown in FIG. 5B prior to formation of the tubular formation. Preferably, when positioned on the outer web 20, about 3 mm of outer web 20 is visible on either side of the inner web 18.

Figure 6A:
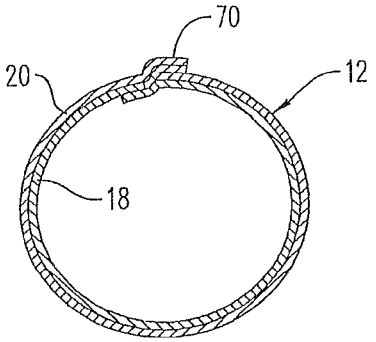
FIG. 6A is a cross-sectional view showing the longitudinal seam of the oral tobacco pouch product utilizing a flavor film that is offset along the ribbon of base web and FIG. 6B is an illustration of the film offset along the ribbon of base web.
Figure 6B:
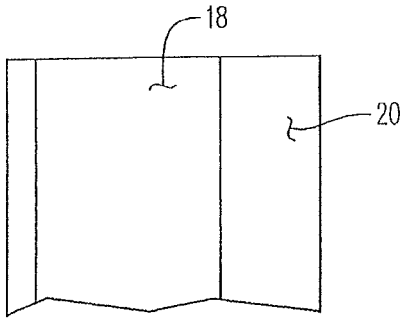

More preferably, as shown in FIG. 6A, the inner web 18, which is preferably a flavor film, overlaps at the fin and lap seal. Such overlapping can be accomplished by offsetting the inner web 18 along the outer web 20 of material prior to formation of the tube as shown in FIG. 6B. Preferably, when the inner web 18 is positioned in an offset along the outer web 20, about 1 to about 2 mm of outer web is visible on one side of the inner web 18 and about 4 mm to about 5 mm of outer web 20 is visible on the other side of the inner web 18. When the inner web 18 overlaps, preferably, the inner web 18 overlaps in the direction the fin seam is folded. Thus, when the inner web 18 overlaps at the longitudinal seal 70, the inner web 18 provides additional strength and a more complete enrobing of the interior of the pouch 10 with the inner web 18.

Figure 7:
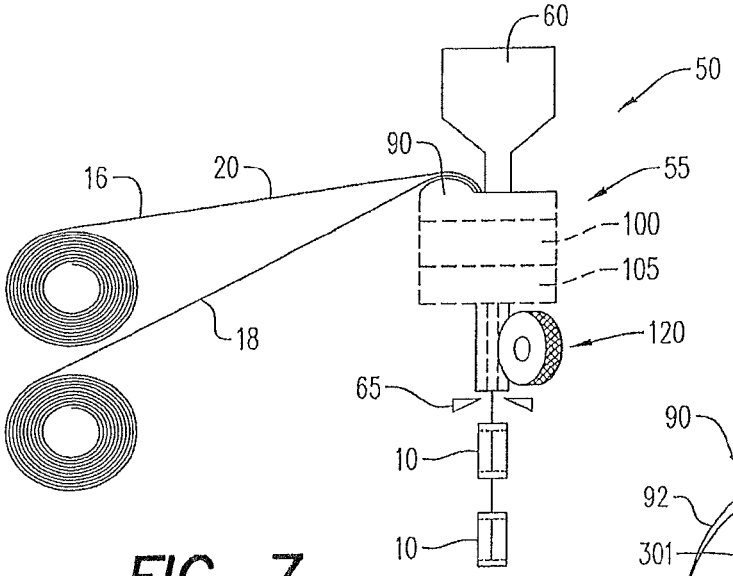
FIG. 7 is a schematic illustration of a machine for forming the oral tobacco pouch product of FIG. 1.
Figure 8:
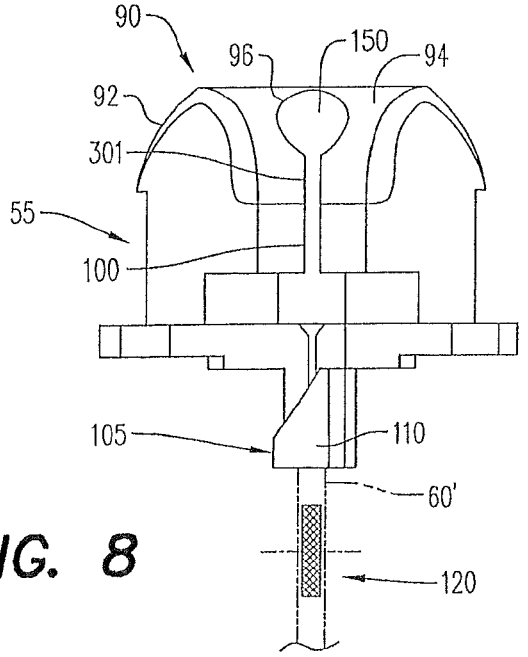
FIG. 8 is a front view of a forming collar for forming a integrated fin and lap seal.

Referring to FIGS. 7 and 8, pouch forming operations can be executed by drawing a ribbon of outer web 20, and optionally, also a ribbon of inner web 18, through a poucher machine 50. Preferably, the poucher machine 50 is a high-speed vertical fill and seal poucher machine. In an embodiment, the outer web 20 can include a coating 16 on a surface thereof. In the preferred embodiment, systems include a forming collar 55 comprising a forming section 90, a fin seam forming section 100 and a fin folding section 105. Disposed immediately below the fin folding section 105 is a sealing station 120, which preferably comprises a heated knurled wheel which cooperates with an extension of a feed tube 60' of a feeder 60 to seal a longitudinal integrated fin and lap seal 70 (shown in FIG. 1). The forming collar 55, sealing station 120, a cutter 65 and the feeder 60 cooperate to repetitively fold the ribbon of web 20 into a tube, close-off and seal an end portion of the tube, feed a measured amount of pouch filling material into the closed-off tube to create a filled portion of the tube and seal and sever the filled portion of the tube to repetitively form individual pouches 10.

Preferably, the filling material is dispensed as a loose filling material. Most preferably, the filling material is fed into the pouches at a density of about 10 to about 50 pounds per cubic foot or about 15 to about 30 pounds per cubic foot.

Figure 9:
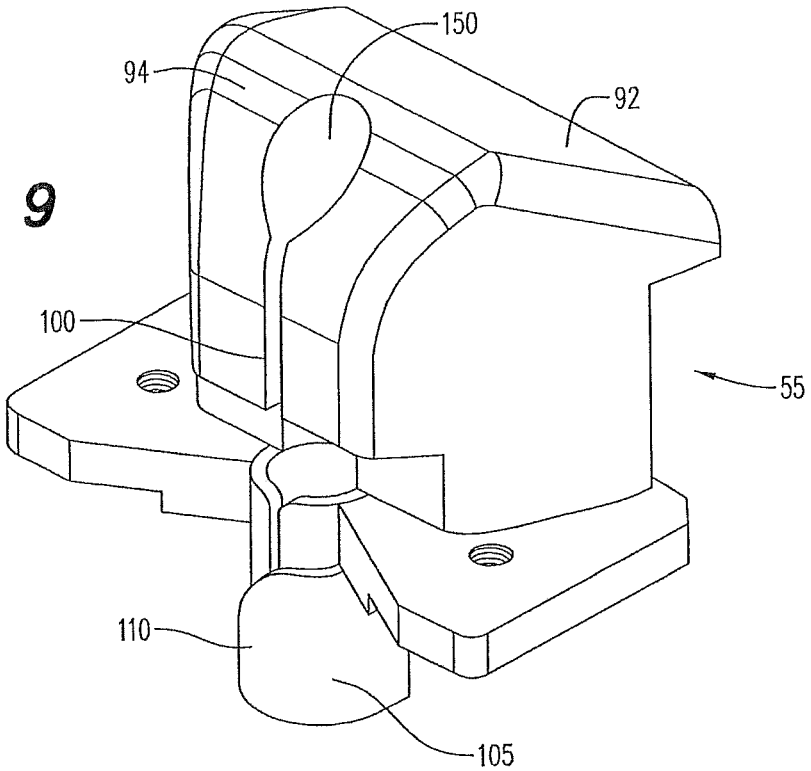
FIG. 9 is a perspective view of the forming collar of FIG. 8.
Figure 10:
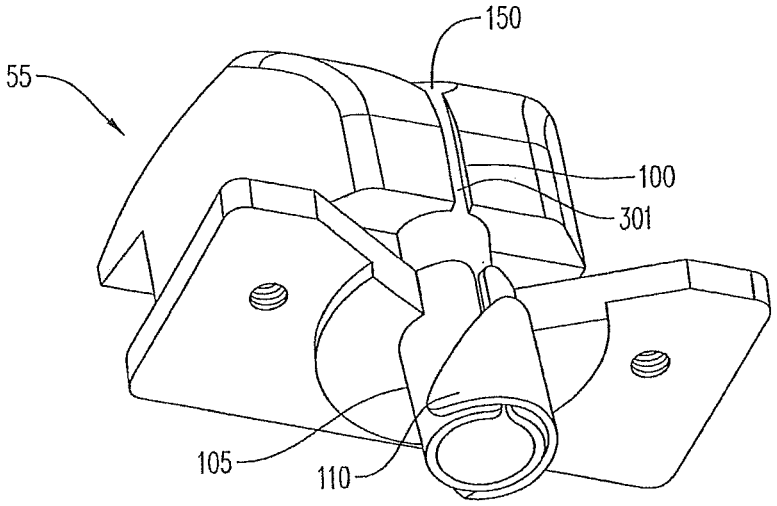
FIG. 10 is a perspective view of the forming collar of FIG. 8
Figure 12:
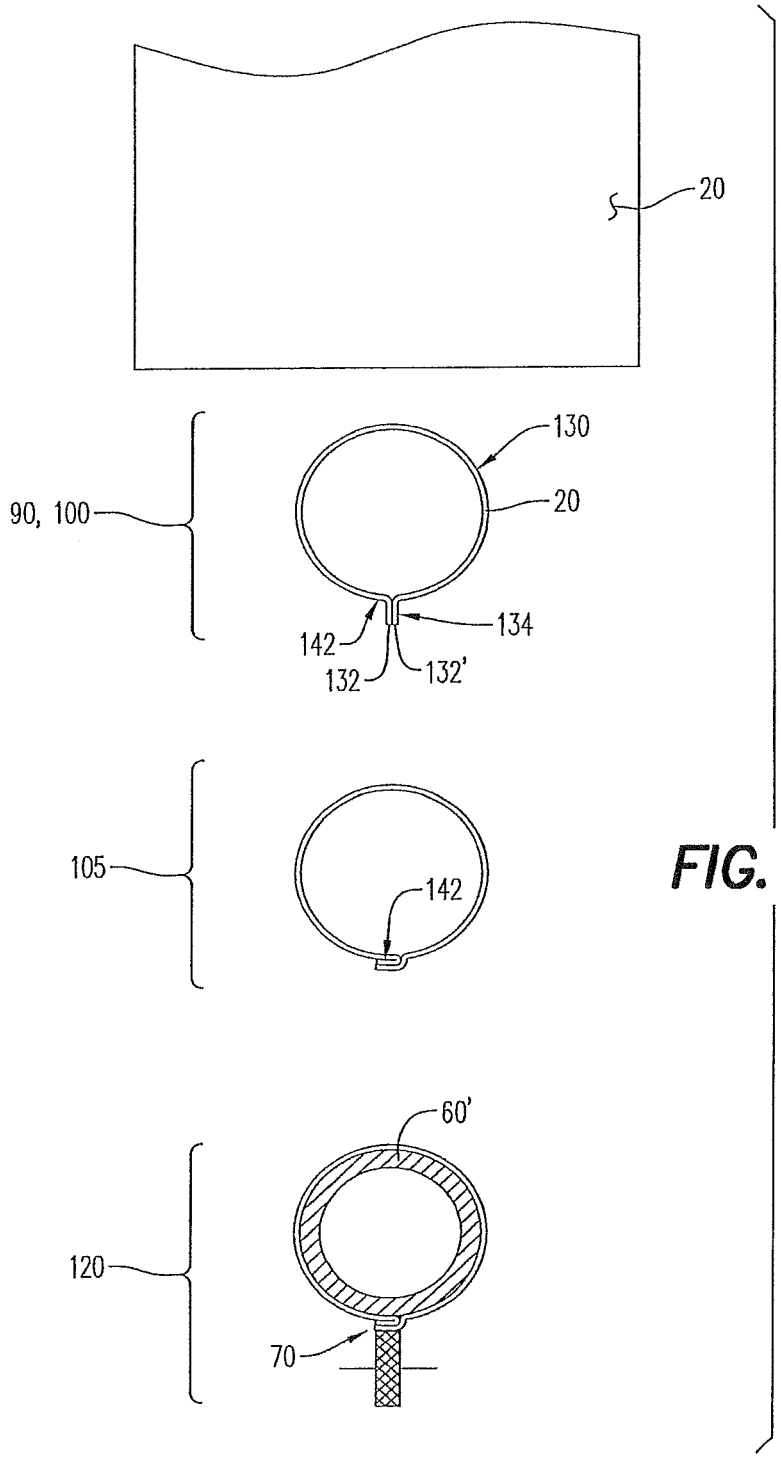
FIG. 12 is a representation of the pouch folding and sealing operations of the embodiments.

Referring to FIGS. 8, 9 and 12, in a preferred embodiment, the forming section 90 comprises a first inclined plane 92 which transitions with a curved surface 94 having an opening 96 to vertical channel or thru-hole 150. As the outer web 20 (and optionally the inner liner 18) is drawn up the inclined surface 92 over the curved surface 94 and into the opening 96, and the ribbon of web 20 is folded into a tubular formation 130 as described in detail below. At the fin forming section 100, opposing edge portions 132, 132' of the outer web 20, and optionally edge portions of the inner web 18, are brought together to form the fin seam 134 which at the folding station 105 is folded over and then sealed to adjacent portions 142 of the folded tubular formation 130 at the seal forming station 120. Preferably, the fin seal is about 2 mm to about 15 mm in width. The forming section 100 is advantageous in its simplicity in comparison to the complicated surfaces used in folding collars to form lap seams.

Preferably, the fin seam 134 is not sealed prior to being folding over and sealed to the body of the outer web 20. However, in an alternative embodiment, the fin seam 134' can be sealed separately and prior to folding and final sealing.

After forming the integrated fin and lap seal 70, oral tobacco pouch products 10 are continuously formed by introduction of predetermined amounts of the filling material 22 into the tubular form above a transverse seam, formation of an upper transverse seam above the filling and cutting the tubular formation at locations along the length of the tubular formation to form individual pouches having the longitudinal integrated fin and lap seal 70.

Sealing of the longitudinal integrated fin and lap seal 70 and/or the transverse seals 14 (shown in FIG. 1) may be accomplished by any suitable sealing method, such as, for example, adhesive or by mutual sealing. Mutual sealing may be thermal or sonic depending on the sealing properties of the web material. Preferably, sealing is accomplished by thermal sealing utilizing a knurled rotatable, heated sealing wheel such as utilized on the aforementioned Merz machine. The sealing operation creates in effect a longitudinal sealed zone along the pouch 10.

As shown in FIG. 8, FIG. 9, FIG. 10 and FIG. 11, the forming collar 55 of the poucher machine includes a fin forming section 100 for forming a fin seam 134. Preferably, it may comprise a vertical slot 301 extending from one side of the thru-hole 150. As the tubular formation 130 further progresses through the forming collar 55, the fin seam 134 is folded over to an outer surface of the web by the folding section 105, which includes a plough 110 for folding over the fin so that it contacts the outer surface of the web.

Figure 11:
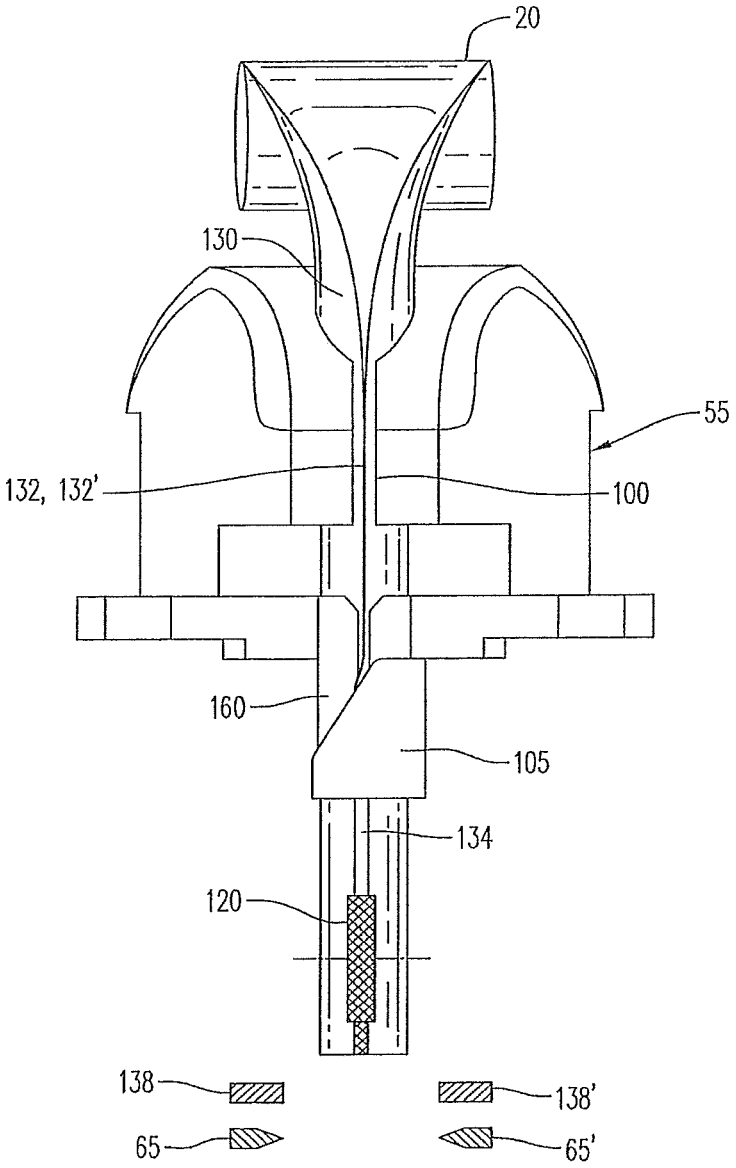
FIG. 11 is an illustration of a web material passing through the forming collar to form a tube having a integrated fin and lap seal.

As shown in FIG. 11, the outer web 20 is drawn over the forming section of the forming collar 55 of the poucher and begins to form a tubular formation 130 within the thru hole 150. The tubular formation 130 immediately enters the fin forming station 100 where longitudinal edge portions are aligned. 132, 132' of the tubular formation 130 to form longitudinal fin 134, which then passes to the fin seam folding section 105 which folds the fin seam 134 so that the fin seam 134 lies against an outer surface 160 of the tubular formation 130. The fin 134 is then sealed to the outer surface 160 of the tubular formation 130 at the sealing stations 120.

Clamping and sealing elements 138 draw the tubular formation through the poucher. The sealing elements 138, which are horizontal in relation to the tubular formation 130, repetitively seal the tubular formation 130 at selected locations to repetitively form transverse seams 14. Preferably, the poucher is programmed to load a measured amount of the product into the tubular formation 120 above each transverse seam 14. A second transverse seal is formed at a spaced apart location along the tube above the first transverse seal after the product has been loaded into the tube to form an oral tobacco pouch product.

In the preferred embodiment, the forming collar 55 produces pouches ranging in width from about 12 mm to about 20 mm. The thru hole 150 of the forming collar 55 can vary in diameter from about 0.25 inch to about 0.625 inch. The diameter of the thru hole 150 can be chosen based on the desired width of the finished oral tobacco pouch product.

In this specification, the word "about" is often used in connection with numerical values to indicate that mathematical precision of such values is not intended. Accordingly, it is intended that where "about" is used with a numerical value, a tolerance of 10% is contemplated for that numerical value. In addition, the use of geometric terms is intended to include not only the precise geometric shapes, but also similar geometric shapes that may, for example, have rounded or chamfered corners, non-linear edges, and similar departures from strict geometrical definitions.

While the foregoing describes in detail an oral tobacco pouch product with reference to a specific embodiment thereof, it will be apparent to one skilled in the art that various changes and modifications equivalents to the oral tobacco pouch product, apparatus and process steps may be employed, which do not materially depart from the spirit and scope of the invention.

I claim:

1. A method of making an oral pouch product comprising:

folding web into a tubular form with opposite longitudinal edge portions in an opposing relation along said tubular form using a vertical fill and seal machine;

forming a fin seam along said opposing edges of the tubular form;

folding the fin seam into a superposed relation to an outer surface of said tubular form;

sealing the fin seam to said outer surface of the tubular form to form an integrated fin and lap seal;

forming a lower transverse seam across the tubular formation;

placing a portion of a loose botanical filling material into the tubular formation above the transverse seam; and forming an upper transverse seam across the tubular formation to enclose the filling material in a pillow-shaped oral pouch product.

2. The method of claim 1, further comprising sealing the fin seam to form a fin seal prior to forming the integrated fin and lap seal.

3. The method of claim 1, wherein the web includes an inner liner, the fin seam established between inner surfaces of opposing edge portions of the web, the opposing edge portions sealed with an adjacent portion of the oral pouch product, wherein the inner liner is not included in the fin seal.

4. The method of claim 1, wherein the web includes at least one coating.

5. The method of claim 1, wherein the filling material includes non-tobacco botanical material selected from the group consisting of vegetable fibers, tea, herbs, spices, coffee, fruits and combinations thereof.

6. The method of claim 5, wherein the non-tobacco botanical material is included in an amount of about 5% to about 45% by weight based on the weight of the inner filling material.

7. The method of claim 1, wherein the filling material includes tobacco material.

8. The method of claim 7, wherein the tobacco material includes moist smokeless tobacco.

9. The method of claim 1, wherein the filling material has a moisture content in the range of about 5% to about 50%.

10. The method of claim 9, wherein the filling material has a moisture content in the range of about 12% to about 25%.

11. The method of claim 1, wherein the web comprises paper.

12. The method of claim 1, wherein the oral pouch product is about 10 mm to about 20 mm in width, about 20 mm to about 40 mm in length, and about 5 mm to about 20 mm thick.

13. The method of claim 1, wherein the web has a thickness of about 0.07mm to about 0.08 mm or about 0.1 mm to about 0.125 mm.

14. The method of claim 1, wherein the vertical fill and seal machine includes a forming collar comprising a forming section adapted to fold the web into the tubular formation, a fin seam forming section adapted to form the fin seam along said tubular formation and a fin seam folding section adapted to fold said fin seam against an adjacent portion of said tubular formation, the forming collar further including a through hole adapted to receive the tubular formation, said fin seam forming section including a slot adjacent said through hole and said fin seam folding section including a plough.

15. A method of forming an integrated fin and lap seal along a body of an oral pouch product comprising the steps of:

forming a fin along a tubular formation using a vertical fill and seal machine;

sealing the formed fin to form a fin seal;

folding the fin seal into a superposed relation with an outer surface of the tubular formation;

sealing the fin seal to the outer surface of the tubular formation to form an integrated fin and lap seal; and placing a portion of a loose botanical filling in an interior of the tubular formation and forming transverse seams to enclose the filling in a pillow-shaped oral pouch product.

16. The method of claim 15, wherein the oral pouch product comprises a pouch wrapper comprising a web folded into a pouched form; a filling material contained by said pouched form; and an integrated fin and lap seal along the pouched form, said integrated fin and lap seal including a fin seam portion established between opposing edge portions of the web, said fin seam portion folded into a superposed relation to an adjacent portion of said pouched form and lap sealed to the adjacent portion of said pouched form along pouched form, wherein at least portions of said opposing edge portions are mutually sealed and sealed with said adjacent portion of said pouched form and the integrated fin and lap seal includes no loose, unsealed edges.

* * * * *